US005462205A

United States Patent [19]

Keller

[11] Patent Number: 5,462,205

[45] Date of Patent: Oct. 31, 1995

[54] PLUGGABLE MULTIPLE CARTRIDGE

[76] Inventor: Wilhelm A. Keller, Obstgartenweg 9, CH-6402 Merlischachen, Switzerland

[21] Appl. No.: 209,740

[22] Filed: Mar. 14, 1994

[30] Foreign Application Priority Data

Mar. 15, 1993 [EP] European Pat. Off. ..... 93810188

[51] Int. Cl.[6] ..... B67D 5/60

[52] U.S. Cl. ..... 222/145.1; 222/325; 222/330; 222/485; 222/545; 222/546

[58] Field of Search ..... 222/94, 135, 136, 222/137, 145, 325–327, 563, 568, 330, 331, 483, 485, 545, 546

[56] References Cited

U.S. PATENT DOCUMENTS

| | | | |
|---|---|---|---|
| 3,570,719 | 3/1971 | Schiff | 222/137 |
| 4,261,481 | 4/1981 | Speer | 222/135 |
| 4,871,090 | 10/1989 | Hoffmann | 222/137 X |
| 4,974,756 | 12/1990 | Pearson et al. | 222/145 X |
| 4,981,241 | 1/1991 | Keller | 222/137 |
| 5,080,262 | 1/1992 | Herold et al. | 222/137 X |
| 5,152,432 | 10/1992 | De Laforcade | 222/145 |
| 5,228,599 | 7/1993 | Keller | 222/137 |
| 5,249,709 | 10/1993 | Duckworth et al. | 222/145 X |
| 5,295,613 | 3/1994 | Barthomeuf et al. | 222/137 |

FOREIGN PATENT DOCUMENTS

| | | |
|---|---|---|
| 0294672 | 12/1988 | European Pat. Off. . |
| 0421860 | 4/1991 | European Pat. Off. . |
| 0467830 | 1/1992 | European Pat. Off. . |
| 0578897 | 1/1994 | European Pat. Off. . |
| 9215072.1 | 2/1993 | Germany . |
| 539551 | 9/1973 | Switzerland . |

OTHER PUBLICATIONS

European Search Report, EP 93 81 0188, completed Aug. 18, 1993.

*Primary Examiner*—Andres Kashnikow
*Assistant Examiner*—Joseph A. Kaufman
*Attorney, Agent, or Firm*—Marks & Murase

[57] ABSTRACT

A pluggable multiple cartridge comprises two separately manufactured and optionally filled storage containers, a common outlet tube socket provided on one storage container, which common outlet tube socket contains a separately disposed channel for each storage container, and the other storage container comprises a dispensing channel pluggable into the common outlet tube socket. Further, the two storage containers can be fixed together at their other ends. Such a pluggable cartridge solves the sealing problems of the outlet parts present in conventional pluggable cartridges.

8 Claims, 5 Drawing Sheets

PLUGGABLE MULTIPLE CARTRIDGE

BACKGROUND OF THE INVENTION

The present invention relates to a multiple cartridge which can be assembled by plugging together single cartridges. In particular, the invention contemplates a pluggable multiple cartridge comprising at least two separately manufactured and optionally filled storage containers having outlets at one end, said outlets being shaped as to form together an outlet tube socket, the other end of said storage containers being attachable together by fixing means.

Pluggable cartridges, formed as double cartridges, are already known and can be found on the market in different forms. They are used for the discharge of two or multicomponent compositions. Pluggable cartridges are appropriate in particular in such cases where one of the components, typically the smaller one, namely the hardener, loses its activity or volatile matter at higher temperatures and must therefore be stored under cooling. Therefore, it is possible with pluggable cartridges to store the smaller storage containers separately under cooling and to combine them just before use with the bigger storage container.

All pluggable cartridges which are already known comprise a partial outlet tube socket on each storage container, and these partial outlet sockets will form a whole outlet socket upon plugging the receptacles together. A static mixing device may be put on the complete outlet tube socket and may be secured by a swivel nut. At their other ends, the storage containers are fixed together by fixing means.

The already known pluggable cartridges have serious problems as to sealing since the partial outlet tube sockets are only pressed together by the mixing device and the swivel nut. Furthermore, the parts at the outlet end require additional interlocking or positioning means. A further disadvantage of known pluggable cartridges is that the two pluggable components are not solidly assembled prior to securing by the swivel nut and have thus the tendency to fall apart.

SUMMARY OF THE INVENTION

Bearing in mind what has now been discussed, the objective of the present invention is to provide a pluggable multiple cartridge which achieves superior holding together and a simple assembling of the parts, wherein the sealing problems are solved, and wherein the manufacture of the smaller storage container has been simplified. This objective is met by a pluggable multiple cartridge wherein a common outlet tube socket is provided on one storage container, said common outlet socket having a separately disposed conduit for every one of the storage containers, the other storage containers each comprising a dispensing channel pluggable into the common outlet tube socket.

Improvements of the pluggable multiple cartridge of the invention are defined in dependent claims.

BRIEF DESCRIPTION OF THE DRAWINGS

The invention will now be explained in more detail by means of the drawings wherein.

DETAILED DESCRIPTION OF THE INVENTION

Figure 1:
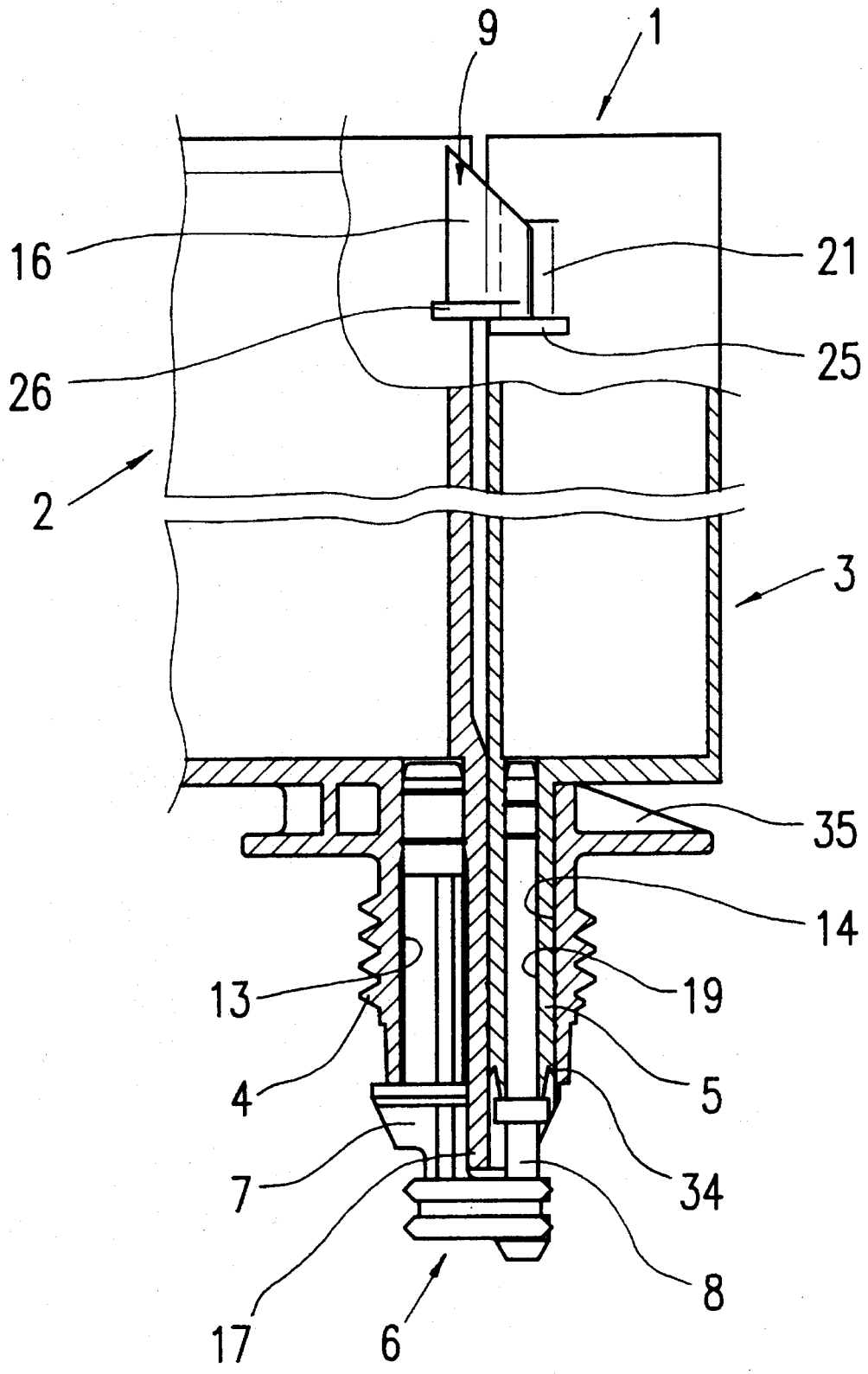
FIG. 1 shows a sectional view of an assembled and closed multiple cartridge.

FIG. 1 shows an embodiment of a plugged-in, assembled double cartridge 1 composed of a bigger storage container 2 and a smaller storage container 3, these containers being shaped as cylinders. The bigger storage container comprises a common outlet tube socket 4 in which the outlet 5 of the smaller storage container is plugged, the two dispensing channels 13 and 19 being separated from each other by a wall 17. The outlet socket comprising the two dispensing channels is closed by a closure 6 composed of a stopper 7 for the bigger storage container and a stopper 8 for the smaller storage container. At their other ends, the storage containers are connected to each other by fixing means 9.

Figure 2:
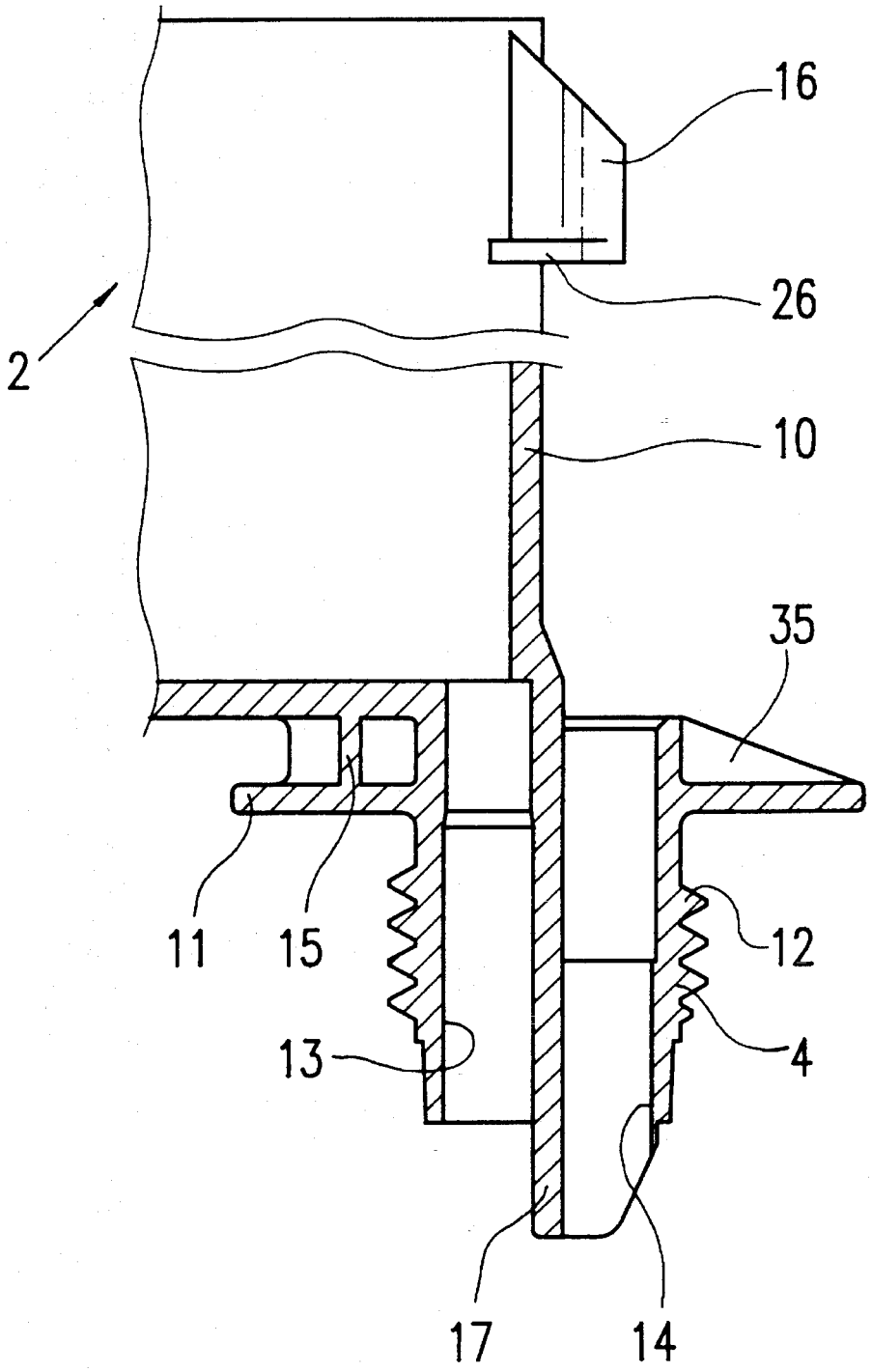
FIG. 2 shows a sectional view of the bigger storage container.

According to FIG. 2, the bigger storage container 2 comprises a cylindrical portion 10 converging towards the outlet end into a flange 11 bearing the outlet tube socket 4 provided with a thread 12. The dispensing channel 13 of the bigger storage container is separated from the tube portion 14 by a wall 17, which tube portion is designed to receive the dispensing channel of the smaller storage container. The flange 11 extends beyond the location where the smaller storage container is inserted, and comprises ridges 15 at the zone of the bigger storage container and reinforcing ribs 35 at the zone above the smaller storage container. The fixing part 16 of the fixing means 9 will be discussed later on with reference to FIG. 4.

Figure 3:
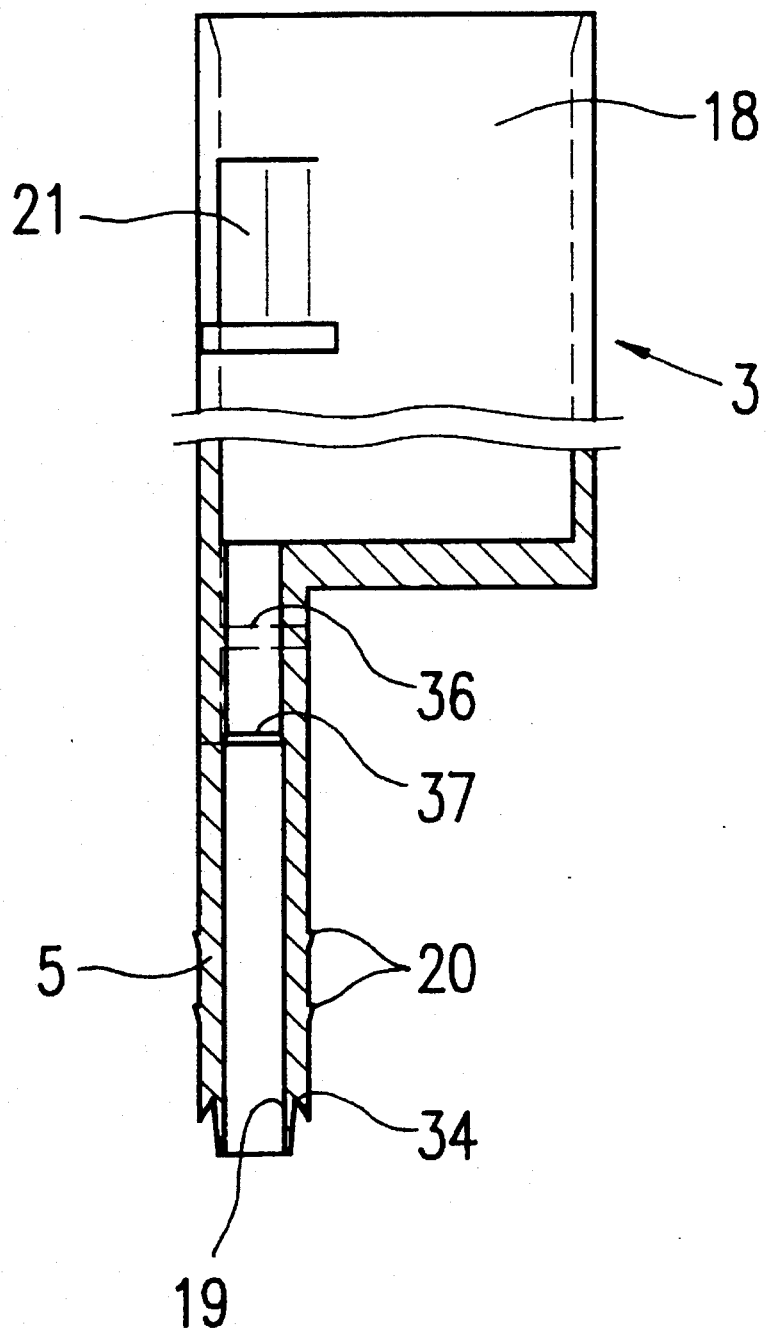
FIG. 3 shows a sectional view of the smaller storage container.

The smaller storage container 3 according to FIG. 3 may be manufactured relatively simply since it need not comprise any outlet tube socket or similar parts. The cylindical portion 18 can be seen and also the tube shaped dispensing channel 19 of the outlet 5 which is equipped with sealing clamping swellings 20 and with a sealing lip 34 at the outlet end.

The other end of the smaller storage container includes the fixing part 21 being complementary to the fixing part 16, the fixing part 21 being explained later on with reference to FIG. 5. In order to stiffen the outlet tube 5, a semicircular reinforcement 36 and a rib 37 are provided at the transition region to the cylindrical portion.

Typically, the outlets or their sections, respectively, are manufactured directly with the predetermined dimension. In some cases, however, it may be more opportune in view of process conditions to provide insertion pieces for smaller sections which, in a known manner, are dimensioned in relation to the sections of the storage containers, for example as shown in U.S. Pat. No. 5,228,599 incorporated herein by reference.

Figure 4:
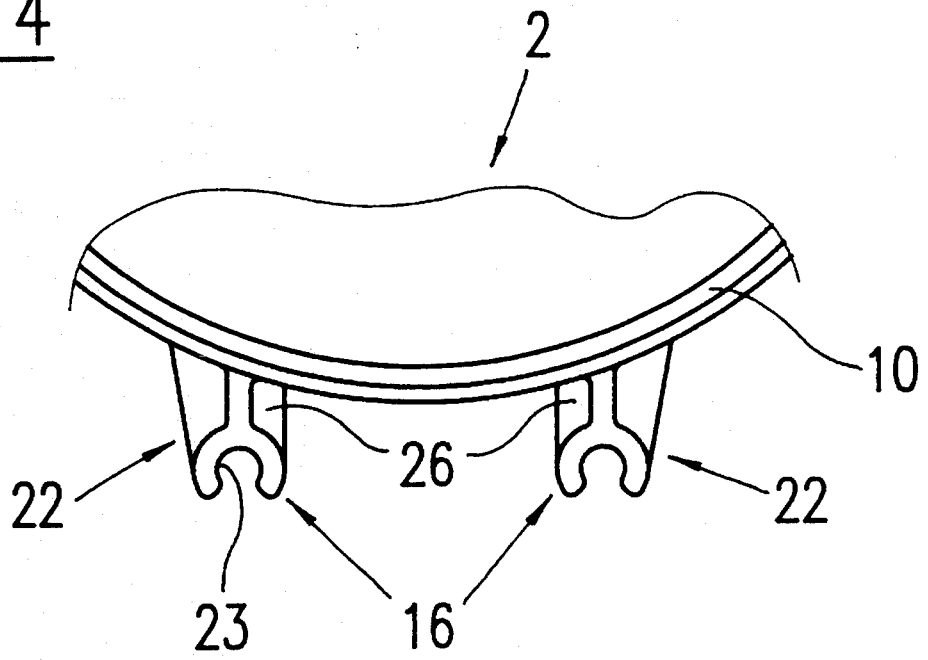
FIG. 4 shows a detail of the lower end of the bigger storage container.
Figure 5:
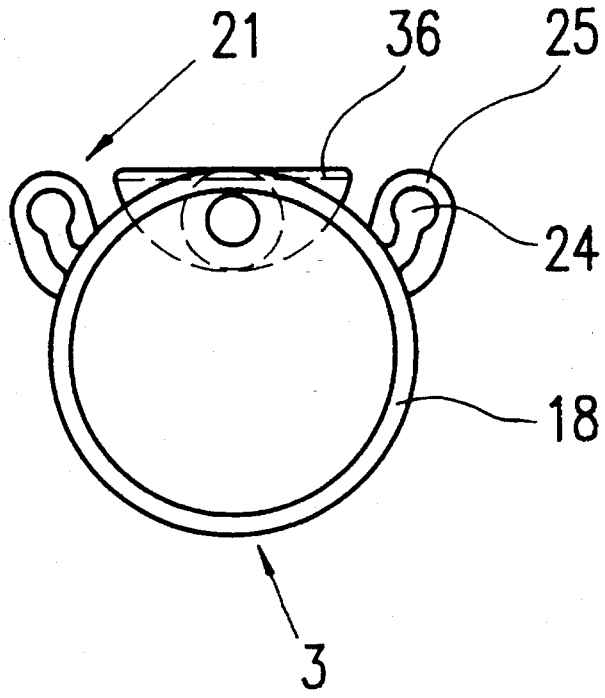
FIG. 5 shows a detail of the lower end of the smaller storage container.
Figure 6:
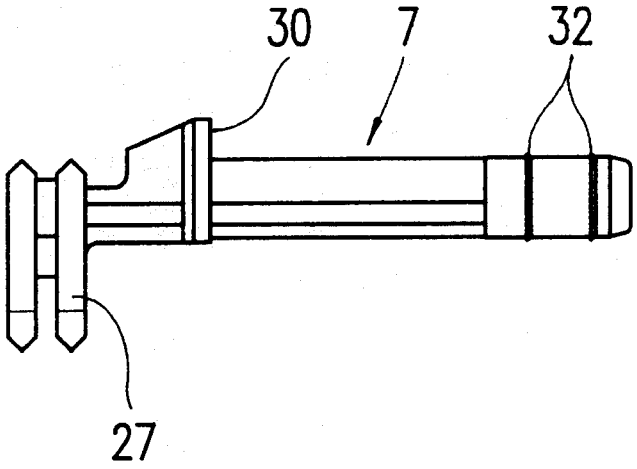
FIG. 6 shows a lateral view of the closure for the bigger storage container.
Figure 6A:
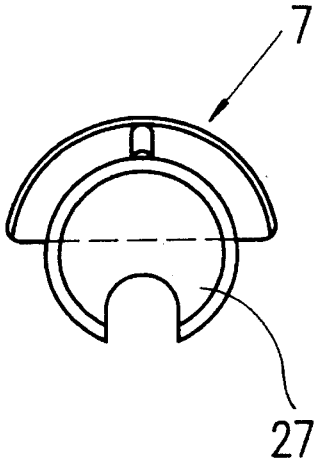
FIG. 6A shows a frontal view of the closure of FIG. 6.
Figure 7:
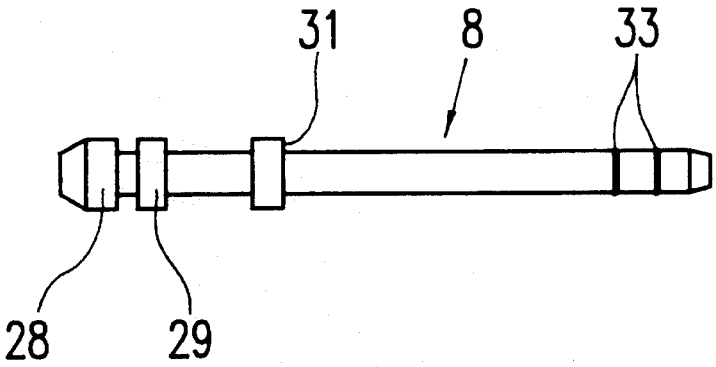
FIG. 7 shows a lateral view of the closure of the smaller storage container.
Figure 7A:
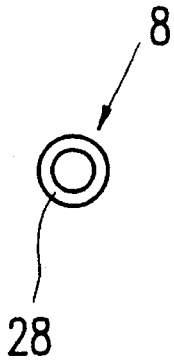
FIG. 7A shows a frontal view of the closure of FIG. 7.

As shown in FIGS. 4 and 5, the fixing parts 16 of the bigger storage container 2 comprise two clamping holders 22 each having a superequatorial clamping surface 23. The fixing parts 21 complementary thereto on the smaller storage container 3 comprise each, seen from below, one cylindric counterpiece 24 which fits in with the clamping holder 22.

The counterpieces 24 on the small storage container are each ended upward by a flange 25, see also FIG. 1, which lies on the flange-like end 26 of the clamping holder 22 in order to prevent downward removal of the smaller storage container.

In FIGS. 6, 6A and 7, 7A, both stoppers 7 and 8 are shown. In conformity with the idea to arrange the common outlet tube socket wholly at the bigger storage container, the head of the bigger stopper 7 is shaped for receiving the smaller stopper 8. The head 27 of stopper 7 is formed as a double flange having a recess in which the head 28 of stopper 8 is received. At the same distance as on the double flange 27, the smaller stopper 8 comprises a ring 29, the double flange and the space between the head 28 and the ring 29 serving for the introduction of a removing tool, e.g. a U-shaped one, for the simultaneous removal of both stoppers as it has already been disclosed in the European Patent Publication No. 0,578,897 for stoppers made of one piece. The remaining portions of the stoppers are disposed as in the one-piece double stoppers already known, and each stopper comprises a closing surface 30 and 31 and sealing means 32 and 33, respectively.

It will thus easily be understood from the description of an embodiment of a double cartridge given above that multiple cartridges having more than two storage containers can also be assembled according to the same principle, comprising the arrangement of the whole, common outlet tube socket at the biggest supply cylinder; the dispensing channels of the smaller supply cylinders are pluggable into said common outlet socket, and the fixing means at the other end of the storage containers may be the same as described or similar ones.

I claim:

1. A pluggable multiple cartridge comprising at least two storage containers, each storage container having at least two ends with an outlet at one end, the other end of said storage containers being attachable together by fixing means, wherein a common outlet tube socket is provided on one storage container, said common outlet tube socket having a socket channel for said outlet of said one storage container, the remaining storage containers each having at said outlet a dispensing channel pluggable into the common outlet tube socket, said common outlet socket having a separately disposed socket channel for receiving the dispensing channels of the remaining storage containers, and wherein said storage containers are positioned in a side-by-side arrangement.

2. The pluggable multiple cartridge according to claim 1, wherein the common outlet tube socket comprises an outer thread, at least one separation wall, a socket channel shaped as a dispensing channel for said one storage container, and the remaining socket channels being arranged for receiving the dispensing channels of the remaining storage containers.

3. The pluggable multiple cartridge according to claim 2, wherein the dispensing channels of said remaining storage containers comprise one dispensing channel.

4. The pluggable multiple cartridge according to claim 1, wherein said fixing means comprise fixing parts at said one storage container and at said other storage containers respectively, the fixing parts at said one storage container comprising two clamping holders having a superequatorial clamping area each and the fixing parts at said other storage containers comprising a cylindrical counterpiece fitting together with said clamping holders.

5. The pluggable multiple cartridge according to claim 4, wherein the clamping holders are provided towards the outlet end with a flange-shaped end piece and each counterpiece with an end flange, the flanges on said other storage containers staying on the end of said one storage container when the multiple cartridge is assembled.

6. The pluggable multiple cartridge according to claim 1, wherein said common outlet tube socket is closed by a closure device comprising a stopper for said one storage container and a stopper for each of said remaining storage containers, each stopper having a head, wherein the head of the stopper for said one storage container is shaped for receiving the heads of the stoppers for said remaining storage containers.

7. The pluggable multiple cartridge according to claim 6, wherein the head of said stopper for said one storage container is shaped as a double flange, and a ring is provided at a distance from the head of the stoppers for the remaining storage containers, wherein said double flange and said ring provided at a distance are arranged for introducing a removing tool into the space between the parts, permitting removal of all stoppers together.

8. The pluggable multiple cartridge according to claim 1, wherein said storage containers are filled.

* * * * *